United States Patent [19]

Robinson

[11] Patent Number: 5,069,399

[45] Date of Patent: Dec. 3, 1991

[54] TARGET FOR CLOSE IN WEAPON SYSTEMS

[75] Inventor: Paul R. Robinson, Salisbury, Australia

[73] Assignee: The Commonwealth of Australia, Australia

[21] Appl. No.: 493,903

[22] Filed: Mar. 15, 1990

[30] Foreign Application Priority Data

Mar. 16, 1989 [AU] Australia ..... PJ3233

[51] Int. Cl.[5] ..... B64D 3/00

[52] U.S. Cl. ..... 244/14; 244/1 TD; 434/12; 434/25

[58] Field of Search ..... 244/14, 1 TD, 3.1, 3.21, 244/3.24; 434/12, 15, 25; 102/378; 89/1.11

[56] References Cited

U.S. PATENT DOCUMENTS

| | | | |
|---|---|---|---|
| 1,977,198 | 10/1934 | Nicolson | 244/1 TD |
| 2,813,719 | 11/1957 | Hopper | 244/1 TD |
| 3,373,994 | 3/1968 | Woodward | 244/1 TD |
| 3,458,197 | 7/1969 | Woodward | 244/1 TD |
| 4,000,867 | 1/1977 | Daikeler et al. | 244/1 TD |
| 4,356,984 | 11/1982 | Worth et al. | 244/1 TD |
| 4,834,317 | 5/1989 | Deppner | 244/1 TD |

FOREIGN PATENT DOCUMENTS

| | | | |
|---|---|---|---|
| 0582842 | 11/1946 | France | 244/14 |
| 0856153 | 12/1960 | France | 244/1 TD |
| 1519116 | 2/1968 | France | 244/1 TD |
| 2616745 | 12/1988 | France | 244/1 TD |

*Primary Examiner*—Michael J. Carone

*Attorney, Agent, or Firm*—Baker, Maxham, Jester & Meador

[57] ABSTRACT

This invention relates to a target which is towed by an aircraft to simulate the approach of an aircraft, missile or similar threat to a Defence System, to provide realistic practice for the Defence System. In accordance with this invention there is provided a target that is connected by a cable to a tow aircraft and towed by the aircraft toward a Defence System at a low approach altitude. The target has flight surfaces that, in combination with the mass of the target, cause the target to be towed at a substantially lower altitude than the tow aircraft. This allows direct ground or sea skimming approach by the target as the tow aircraft overflys the Defence System. The target is provided with a cable release means that releases the target at a predetermined safety range, whereupon the cable rises to a free streaming height and clears the Defence System.

7 Claims, 5 Drawing Sheets

TARGET FOR CLOSE IN WEAPON SYSTEMS

This invention relates to a target for fully exercising Defence Systems, and in particular it relates to a target which is towed by an aircraft to simulate the approach of an aircraft, missile or similar threat in order to provide realistic practice for a Defence System.

Defence Systems such as close in weapon systems are designed to locate, track, and then fire on and destroy an approaching threat, such as a low altitude approach of a missile or aircraft. The function of any target for close in weapon systems practice is therefore to mimic closely the approach of such threats. At the same time however, adequate safety margins for personnel or equipment on or near the close in weapon systems must be ensured to prevent impact by a target approaching a low altitude.

Close in weapon systems are commonly installed on Naval vessels and targets towed by aircraft are used to provide practice. Obviously, there is a need for simulating attacks on vessels by sea skimming missiles or aircraft to practice and become skilled in the use of the weapon systems.

In respect of shipborne close in weapon systems or any other similar Defence System, it is preferable that a target be towed directly towards the Defence System. However, the obvious problem with direct approach by a target is collision with the Defence System. A further problem is impact with the tow cable. The tow cable is normally 5 km in length, and due to the weight of the cable and the weight of the target, the target is normally towed at an altitude lower than the aircraft. This is called the free streaming height. Although a tow aircraft approaching a vessel with the target close to sea level may clear the vessel, the cable, at some point, will not.

Presently available target systems address the abovementioned problems by providing a less than realistic target approach scenario. Examples include towing targets on a track laterally offset from shipborne Defence Systems or towing the target along one side of the vessel. In addition, remotely piloted targets have been used. However, hazards with such a target is increased as the necessary power source for flight of the vehicle, and associated control mechanisms, greatly increase the mass of the vehicle. This means that greater damage may be caused should control of the remotely piloted target be lost. This can easily occur if the onboard controls are damaged by a projectile from the weapon system. Therefore, presentations of such remotely controlled vehicles are normally terminated at less than desirable ranges from the vessel.

It is desirable that a target should approach a Defence System directly at low altitude, and preferably maintain a preset mean height of between 3–15 meters above ground or sea level to within tolerance of ±20%. The tow aircraft should approach the Defence System from beyond the acquisition range of the weapons, and fly on a track that is directly towards the Defence System. The tow aircraft and the trailing cable should clear the vessel. When the tow aircraft is past the Defence System the weapons then fire at the target.

This is impossible to achieve with existing towed targets. As mentioned, there is little chance of avoiding impact with the Defence System by either the cable or target. This necessitates either flight lines fore or aft, or towing the target at a higher level, or initiating a target climb manoeuvre at an unacceptable range.

Therefore, it is an object of this invention to provide a target for use with Defence Systems that overcome the abovementioned problems.

It is a further object of this invention to provide a target for use with Defence Systems that provides a realistic training scenario where the target approaches the Defence System at a low altitude that is similar to an attacking missile or aircraft.

It is a further object of this invention to provide a method for presenting an aerial target to a close in Defence System.

In its broadest form, the invention comprises a target that is connected to a tow aircraft and towed by the tow aircraft toward a ground or shipborne Defence System comprising a target fuselage having controllable flight surfaces that in combination with the mass of the target result in a downward force that causes the target to be towed at a substantially lower altitude in relation to the tow aircraft, the flight surfaces being controlled such that as the tow aircraft flies toward the Defence System, the target fuselage approaches the Defence System at a low altitude a cable release means that upon receiving a control signal operates to disconnect the cable from the target, and control means that provides a control signal to the cable release means at a predetermined time to cause release of the cable from the target, the tow aircraft being flown at a height which allows for the free end of the cable to rise due to aerodynamic forces to a height sufficient for the cable to safely pass over the Defence System.

A further aspect of the invention is a method of presenting a target as described above, at a Defence System that comprises flying the tow aircraft and target directly towards a Defence System, and when the tow aircraft has flown over or past the Defence System, the Defence System engages the target, and at a predetermined distance from the Defence System the control means provides a control signal to the cable release means, thereby releasing the cable, whereupon the target dives to destruction, and the end portion of the cable rises so as to clear the Defence System as it passes over.

Due to the low inertial mass of the tow cable, together with the high aerodynamic loads placed thereon, the free end of the tow cable that is released from the target body will be caused to rise rapidly following its release.

It is required that the flight surfaces on the target fuselage are movable or controlled in some manner so that the altitude of the target may be controlled. In combination with altitude sensors, it is possible to control the height of the target to fly close to the surface of sea or land. In addition, it is possible to control the height difference between the tow aircraft and the target such that if desired, the target body can be brought down to attack altitude, and then flown back to the same altitude as the tow aircraft in order to clear the Defence System.

The downward force created by the flight surfaces, which is combined with the mass of the target, and the aerodynamic forces on the cable, have the effect of causing the cable to have a high angle of elevation with respect to the target which reduces the radius of curvature as the cable curves down to the target. Therefore a majority of the cable is towed at a free streaming height, with a minimal portion at the end curving down to the target. This enables a close approach of the target towards the Defence System.

It is important that the cable release means provide sure and quick release of the cable from the target. Preferably, this is obtained by having explosively actuated cutters detonate to quickly and surely sever the connection of the cable to the target body. It may be desirable to have more than one cable release means to ensure cable release in the event that a projectile damages any of the cable release means.

The invention includes a control means for operating the cable release means and preferably for controlling other functions of the target. The control means may comprise a micro-processor in combination with radio receiving and transmitting devices. In addition, it is preferable that altitude and range sensing devices provide information to the control means, and that the operation of the flight surfaces be controlled by the control means. The range sensor may comprise a radar system that is associated with the Defence System.

The operation of the control means will be important in respect of flight termination of the target. The flight termination system will prevent the target from coming within a predetermined range of the Defence System, wherein the predetermined range is a minimum safety range from the Defence System. Should the Defence System fail to destroy the target outside of this minimum safety range, then the flight termination system will operate so as to automatically release the cable. The location of the safety range will mainly depend upon speed of target approach and height of the Defence System. Careful assessment will need to be made to determine an adequate safety range for each Defence System.

During the period that the Defence System is firing on the target, if the target becomes either critically damaged, or if there is some other component failure, then the flight termination system will activate to release the cable from the target. The control means may be provided with diagnostic checking routines that continuously check all of the components on the target for correct operation. If there is a component failure then termination of the target will occur.

A command control and communication network between the Defence System and tow aircraft, and between the tow aircraft and target is provided. It is preferable that a continuous signal is transmitted from the Defence System to the tow aircraft, and in turn that this signal is re-transmitted from the tow aircraft to the target. Provided that this signal remains continuous, then the target presentation to the Defence System will continue. However should the signal be interrupted, then the target will automatically terminate. In addition, there are communication commands transmitted from the tow aircraft to the target body that include arming and disarming of the cable release means, setting the desired altitude of the target body, and initiating controls to lower the target body to the set height or to raise the target body to the altitude of the tow aircraft.

Upon termination of the target through operation of the cable release means, it is preferable to immediately activate a deceleration means. The deceleration means may comprise any device that creates drag, and preferably some form of material drag chute is used. The material drag chutes will be damage tolerant, and will be able to survive several punctures by projectiles while still performing adequately upon release.

Preferably, the target will have a low mass and have a fuselage structure that is damage tolerant and energy absorbing. In the unlikely event that complete control of the target body is lost, then collision with the Defence System should result in minimal damage being caused by the target.

A preferred embodiment of the invention will now be described, but it will be realised that the invention is not to be confined or restricted to any one or combination of the features of this embodiment. The embodiment is illustrated in the accompanying drawings in which.

The following preferred embodiment will be in relation to a target approaching a Defence System comprising a shipborne close in weapon system. The close in weapon system comprises radar controlled rapid fire machine guns such as the Phalanx System. The radar acquires incoming threats such as sea skimming missiles or aircraft as they approach the vessel, and once in range, the rapid fire machine guns commence firing on the threat. The radar is continually able to sense the range of the target, and the aim of the machine gun is controlled by the radar system. Attacking missiles are particularly dangerous for vessels, as they approach at extremely low altitude across the sea, and they are very difficult to locate visually. Such an attack can place great stress on personnel and weapon systems, and it is important to provide practice for developing the necessary skills.

Figure 1:
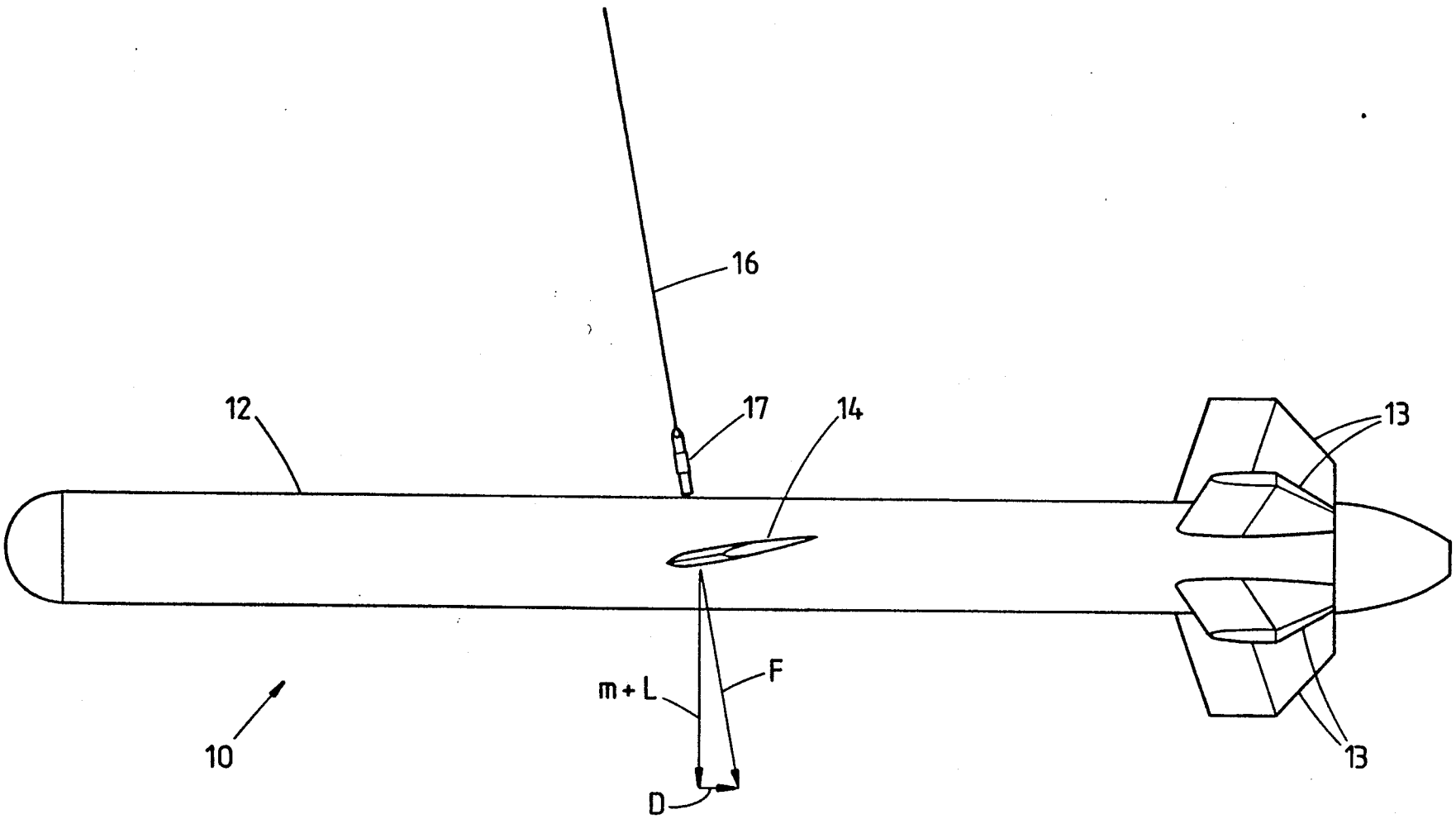
FIG. 1 shows a side view of the target with cable attached, together with a superimposed force vector diagram.

The target 10 in accordance with this embodiment is shown in FIG. 1. It comprises a target fuselage 12 having flight surfaces comprising tail fins 13 and wings 14. A cable 16 is attached to the target 10 by a cable connector 17.

The wings 14 are rotatable about a horizontal axis that is normal to the longitudinal axis of the target fuselage 12. This enables the angle of attack for the wings 14 to be adjusted so as to produce positive or negative lift as required. Superimposed on FIG. 1 is the force vector diagram that illustrates the force applied to the cable 16. The force m+L represents the combined effect of the mass m of the target 10, combined with the lift L created by the wings 14. As shown in FIG. 1, the lift component L is negative and directed downwardly, and combined with the drag vector D results in force F being applied to the cable 16.

Figure 2:
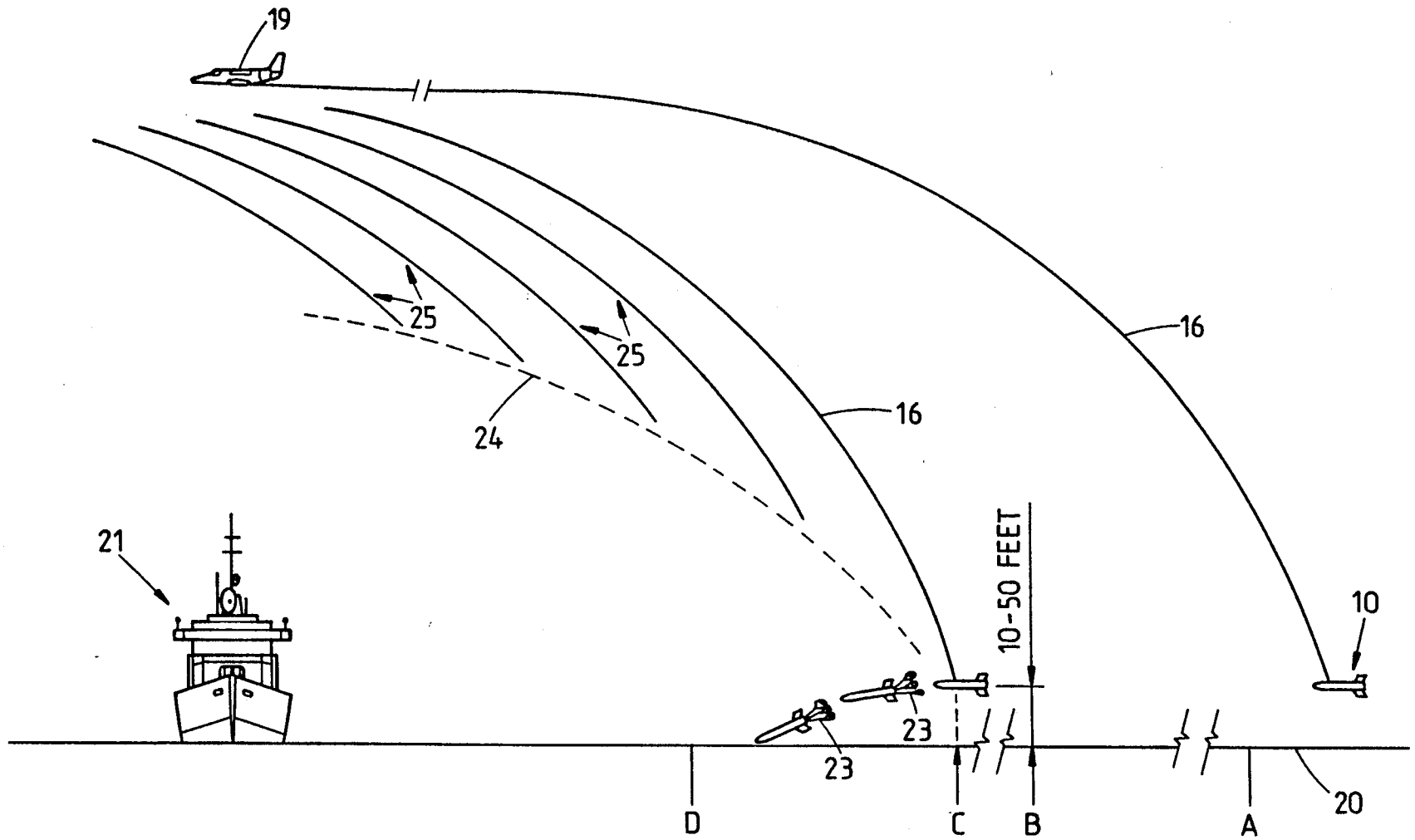
FIG. 2 shows the approach of a tow aircraft and target towards a shipborne close in weapon systems, and shows the sequence of events following termination of the target.

FIG. 2 shows a tow aircraft 19 towing the target 10 by a cable 16. The force F can be varied by adjusting the angle of attack of the wings 14. Therefore, the distance that the target 10 flies below the tow aircraft 19 can be adjusted, or alternatively the height above the sea level 20 that the target 10 flies can be controlled.

Flying of the target 10 below the tow aircraft 19 results in the cable 16 curving towards the target 10, and the resultant aerodynamic forces on the cable 16 cause tension in the cable 16 which is balanced by the down load force F produced by the target 10.

FIG. 2 shows an approach of a tow aircraft 19 and target 10 towards a vessel 21. Following deployment of the target 10 behind the tow aircraft 19, the target 10 will be towed at approximately 600 meters below the tow aircraft 19, on a cable 16 approximately 4500 meters in length. The wings 14 will be positioned to produce negative lift causing the last 100 meters (approximate) of the cable 16 to assume a high angle of elevation with respect to the target fuselage 12. The target 10 is controlled to maintain height above the sea level 20 of approximately 3–15 meters with a tolerance of ±20%.

The tow aircraft 19 approaches the target vessel 21 from beyond the acquisition range of the close in weapon systems radar shown as point A. It follows a track such that the target 10 will fly directly towards the vessel 21. When the tow aircraft 19 has passed overhead of the vessel 21, and when the target 10 is within the acquisition range, shown diagramatically as between points B and C in FIG. 2, the weapons system will then engage the target 10.

If the target 10 is critically damaged within the acquisition range or if it reaches a predetermined minimum acquisition range from the ship which is point C, then the flight of the target 10 is terminated. The flight of the target 10 is terminated by releasing the cable 16 from the target 10, and as the cable 16 is released, a deceleration means shown as drag chutes 23 are deployed. In addition, the wings 14 may be rotated to form negative lift. This will ensure that the target 10 when released from the cable 16 ditches outside of a predetermined safety range indicated by point D.

After release of the cable 16 from the target 10, the high aerodynamic loads on the cable 16, coupled with its relatively low mass, will cause the free end of the cable 16 to rapidly rise. FIG. 2 shows the path 24 of the free end of the cable 16 after release of the cable 16. Provided that the cable 16 is released before the safety range at point D, the end of the cable 16 will rise and clear the vessel 21. FIG. 2 shows progressive positions 25 of the cable 16 as it progresses along the path 24.

In a method of operating the target 10 in accordance with this embodiment, the target 10 starts at the free streaming altitude as it approaches the vessel. The wings 14 are positioned to provide neutral lift. Prior to the target 10 reaching the acquisition range of the weapon system's radar, the wings 14 are rotated to produce negative lift, and the target 10 is lowered to a sea skimming altitude. This causes the downward curvature of the end of the cable 16.

Prior to presenting the target 10 for a live firing run, it is possible to fly the target 10 towards the vessel 21 on a calibration run that allows the radar of the close in weapon systems to acquire the target 10, and ensure that it can acquire and track the target 10. At the end of the calibration run, or before the target 10 reaches the predetermined minimum range from the vessel 21, the wings 14 are rotated so as to provide positive lift and the target 10 can be flown up and over the vessel 21.

On a live firing run, when the tow aircraft 19 passes the close in weapon systems maximum acquisition range at point A, the target 10 is brought to a sea skimming altitude, whereupon the weapons commence firing on the target 10. At a predetermined distance from the vessel 21, which is the minimum acquisition range from the vessel 21 shown as point C in FIG. 2, the cable 16 is automatically released from the target 10, whereupon the drag chutes 23 are deployed, and the target 10 dives to destruction. The cable 16 then rises rapidly to an altitude which will clear the vessel 21 as it flies overhead.

Figure 3:
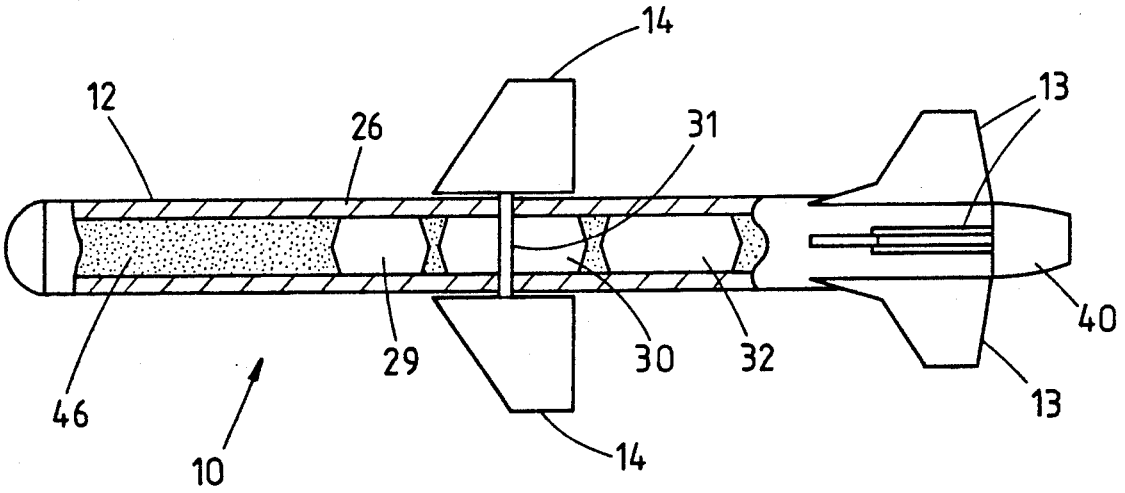
FIG. 3 shows a part cut-away plan view of the target body.

FIG. 3 shows the structural features of the target 10. The target fuselage 12 is generally cylindrical, and is provided with a pair of wings 14, and a plurality of tail fins 13. The body skinning 26 preferably comprises a low density material which results in the body skinning 26 having a thick wall which is advantageous in increasing the damage tolerance and providing a high level of energy absorption in the event of an impact.

FIG. 3 shows the various control elements located within the target fuselage 12. The Phalanx radar system is used to determine the distance of the target 10 from the vessel 21. An altitude sensor 29 is used to determine the height of the target 10 from sea level 20. Electric servo motors 30 are attached to the shaft 31 between the wings 14 to enable their rotation. The shaft 31 is rotatably mounted through the target fuselage 12, and the wings 14 are attached to either side of the shaft 31. The shaft 31 has a crank arm (not drawn) that is in turn connected to the servo motors 30, and the required angle of attack for the wings 14 can be obtained through operation of the servo motors 30.

Figure 5:
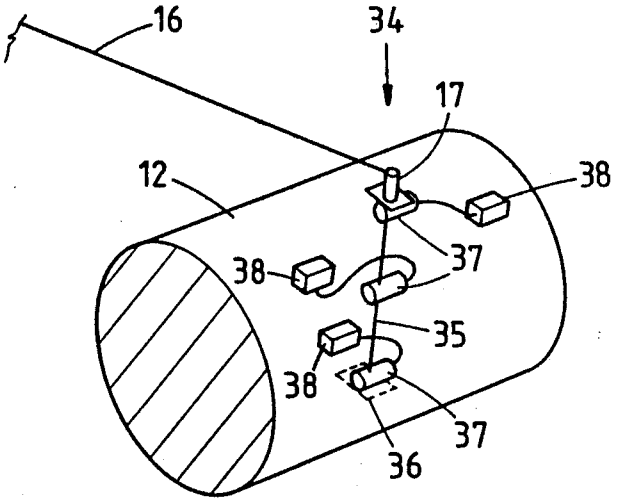
FIG. 5 shows the cable release means.

Finally, control means 32 is provided for receiving information from the various sensors, and providing the necessary control signals for operation of the wings 14 and the cable release means 34 (FIG. 5). In this embodiment, the control means comprises a micro-processor, combined with a radio receiver and transmitter. This enables the control means 32 to obtain information from the tow aircraft 19 regarding height settings or target termination, and together with information received from altitude sensor 29, the control means 32 can fly the target 10 at the required altitude, and terminate its flight by release of the cable 16.

Figure 4:
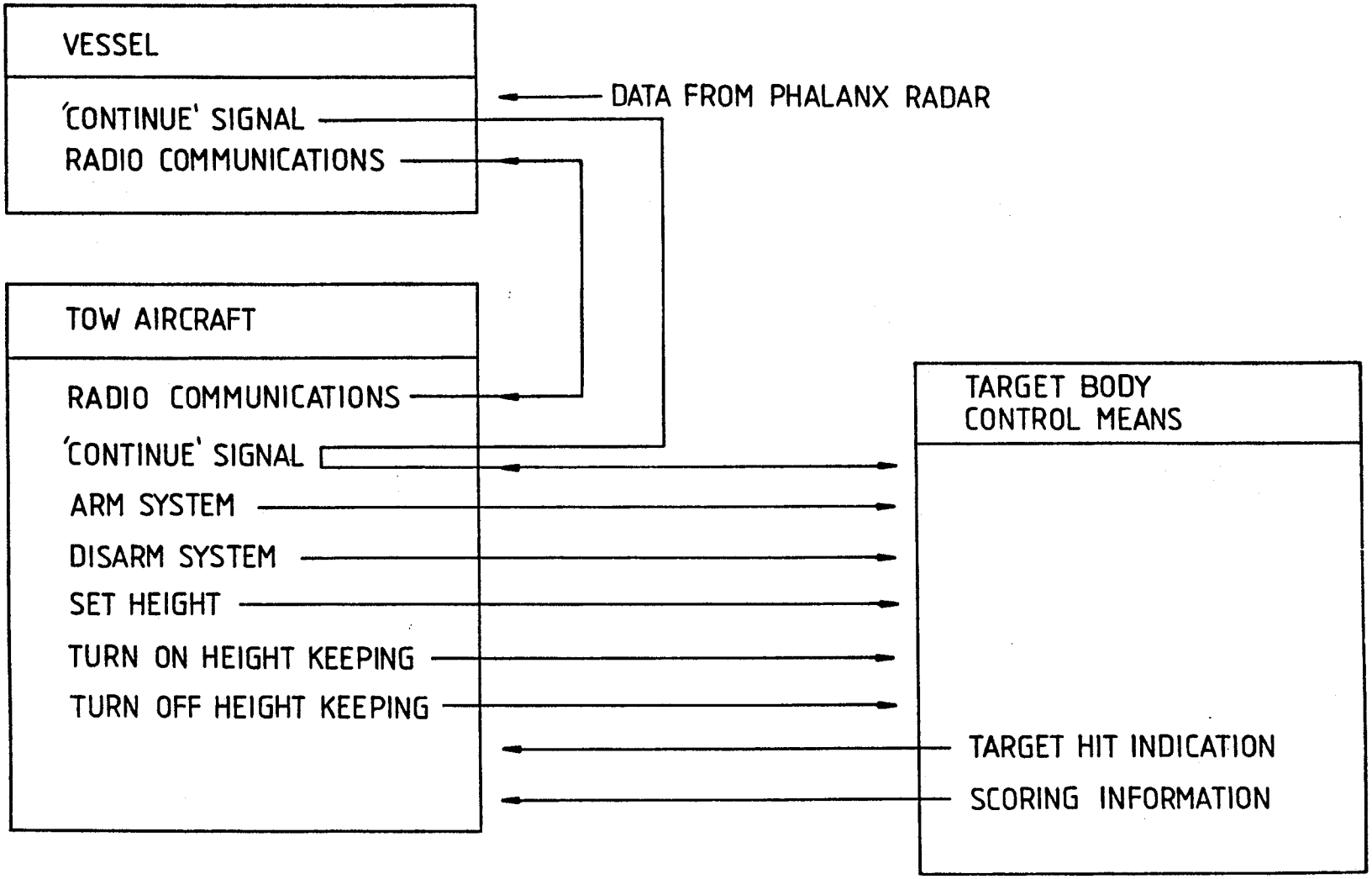
FIG. 4 shows the command control and communication network.

FIG. 4 shows in a block diagram a representation of the communications between the vessel 21 and the tow aircraft 19, and between the tow aircraft 19 and the control means 32 in the target 10. The majority of the command signals to the control means 32 originate from the tow aircraft 19. However, a signal is transmitted from the vessel 21 to the control means 32 via the tow aircraft 19, that is transmitted on a continuous basis. This "continue" signal must always be present, and interruption of the signal indicates that the vessel 21 has had some form of equipment or communication failure, or wishes the presentation of the target 10 to be terminated. This continued signal can be manually interrupted when the presentation of the target 10 is to be terminated, or can be automatically interrupted should there be some form of equipment failure.

In this embodiment the means for constantly assessing the range of the target 10 from the vessel 21 is the radar associated with the Phalanx System. When the target 10 reaches the predetermined minimum acquisition range from the vessel 21, as measured by the Phalanx radar, then the "continue" signal is interrupted, thereby terminating presentation of the target 10.

The communications from the tow aircraft 19 to the control means 32 comprise a number of functions. The first is setting the height at which the target 10 is to fly, and this is achieved by transmitting the required information to the control means 32 where it is stored. When the "turn-on height keeping" command is transmitted to the control means 32 the control means 32 will operate the wings 14 until the altitude sensor 29 indicates that the required set height has been obtained. The target 10 will maintain this set height by the control means 32 adjusting the wings 14 via the servo motors 30 in accordance with the information received from the altitude sensor 29.

The target 10 can be flown back to the free streaming altitude as the tow aircraft 19 by sending the "turn-off height keeping" signal to the control means 32. When this signal is received, the control means 32 adjusts the wings 14 via the servo motors 30 to a neutral position, which results in the target body 12 raising to a normal free streaming altitude behind the tow aircraft 19.

In addition, the tow aircraft 19 can transmit information to the control means 32 in relation to arming or disarming the cable release means 34.

The cable release means 34 is shown schematically in FIG. 5 which shows a portion of the target fuselage 12. As shown in FIG. 5, a cable 35 is secured to a base plate 36 on the inside lower surface of the target fuselage 12. The other end of the cable 35 is secured to a cable connector 17. At spaced intervals along the cable 35, there are positioned three explosively actuated cutters 37 that can be detonated to sever the cable 35. Once the cable 35 has been severed, then it will release the main cable 16 from the target 10.

Each explosively actuated cutter 37 is electrically connected to a detonator 38 which comprises a charged capacitor. Each detonator 38 can either receive signals from a control means 32, or in addition will automatically detonate should power to the detonators 32 be lost through projectile impact. The charge in the capacitor will be sufficient to detonate the explosively actuated cutters 37.

Although the cable release means 34 might operate quite satisfactorily with one explosively actuated cutter 37, additional explosively actuated cutters 37 are provided on a redundancy basis, in case there is a failure of any of the detonators 38, or if any of the detonators 38 are damaged by a projectile. Obviously, it is most important that the cable 16 is released when required, and the provision of redundant systems increase the safety factor.

Figure 6:
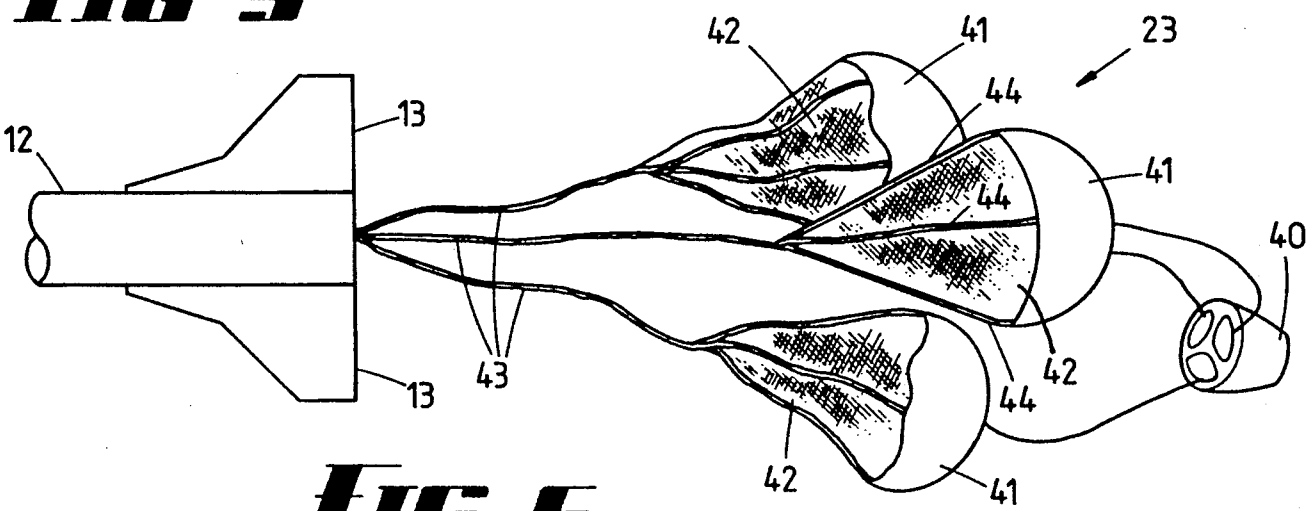
FIG. 6 shows deployment of the drag chutes from the target body.

Upon release of the cable 16, the control means 32 also deploys the drag chutes 23. As seen in FIG. 6, the drag chutes 23 are stored in a tail of the target fuselage 12, and are deployed by jettisoning the tail cone 40. In this embodiment, three drag chutes 23 are provided, and each drag chute comprises a parachute 41 that is attached to a cone 42 of perforate material. Each cone 42 is in turn attached to a tether 43 that is connected to the tail end of the target fuselage 12.

The perforate material in the cone 42 enables the parachute 41 to deploy, and gives the preferred alternative in relation to the conventional plurality of cords which are secured around the rim of the parachute. These cords may tangle and prevent the parachute from deploying, whereas the cone 42 is not able to tangle, and it will ensure proper deployment of the parachute 41. The perforate material can be strengthened by strips 44.

Another advantage of the drag chutes 23 is that they will continue to function adequately even though several projectiles may have pierced the drag chutes 23 prior to deployment.

As mentioned previously, it is important that the construction of the target fuselage 12 result in a damage tolerant structure, that will also absorb impact force. Accordingly, as shown in FIG. 3 the space around the various components within the target fuselage 12 are filled with an energy absorbing material 46. This may comprise of a foam or a honey-comb material that absorb energy upon compression.

Further, in order to increase the damage tolerance of the system, the internal components are packed in energy absorbing material. Any high density component such as the servo motors 30 are secured to the target fuselage 12 by energy absorbing mounts so as to prevent entire dislodgement of the component. Further, unprotected, soft, or safety critical items are protected by shields from components that may generate debris upon being hit by a projectile.

The target fuselage 12 is provided with sensors which will detect the proximity of projectiles that pass in the vicinity of the target 10. These proximity sensors are commonly used on such targets, and give means of detecting the percentage of projectiles that miss hitting the target 10.

The control means 32 is provided with a program that continuously checks the operation of all the various on-board components. Therefore, should a projectile hit and seriously damage any of the components essential to the operation of the target 10, then termination will immediately occur.

A brief consideration of the above description will reveal that the invention provides not only a realistic target for close in weapon systems, but a target that is extremely safe to use.

I claim:

1. A target that is connected by a cable to a tow aircraft and towed by the tow aircraft toward a defense system, said target comprising:

a target fuselage having flight surfaces that in combination with the mass of the target result in a downward force that causes the target to be towed at a substantially lower altitude in relation to the tow aircraft, the cable extending through the upper surface of the target fuselage and being secured to the lower inside surface of the target fuselage;

a cable release means within the target fuselage that upon receiving a control signal operates to disconnect the cable from the target; and a control means that provides a control signal to the cable release means at a predetermined time to cause release of the cable from the target;

said cable release means comprising a plurality of explosively actuated cutters that are detonated upon receiving said control signal, each said explosive charge by itself being able to sever the connection of the cable to the target, said explosively actuated cutters being positioned along the length of the cable within the target fuselage.

2. A target that is connected by a cable to a tow aircraft and towed by the tow aircraft toward a defense system, said target comprising:

a target fuselage having flight surfaces that in combination with the mass of the target result in a downward force that causes the target to be towed at a substantially lower altitude in relation to the tow aircraft;

a cable release means within the target fuselage that upon receiving a control signal operates to disconnect the cable from the target;

a control means that provides a control signal to the cable release means at a predetermined time to cause release of the cable from the target; and a radar system associated with the defense system that sense the distance between the target and the defense system, and upon the target reaching a predetermined distance from the defense system, the control means is caused to provide the control signal to release the cable.

3. A target according to claim 2 further comprising a communication network between the Defence System and the tow aircraft and between the tow aircraft and the target wherein the Defence System transmits a continuous signal that is received and re-transmitted by the tow aircraft to the target body, wherein the control means is caused to provide a control signal to release the cable when the continuous signal ceases or is interrupted.

4. A target that is connected by a cable to a tow aircraft and towed by the tow aircraft toward a defense system, said target comprising:

a target fuselage having flight surfaces that in combination with the mass of the target result in a downward force that causes the target to be towed at a substantially lower altitude in relation to the tow aircraft;

a cable release means within the target fuselage that upon receiving a control signal operates to disconnect the cable from the target;

a control means that provides a control signal to the cable release means at a predetermined time to cause release of the cable from the target, the control means further comprising a radio transmission receiver that enables a radio transmission from a location remote from the target to cause the control means to provide the control signal to release the cable; and a radar system associated with the defense system that senses the distance between the target and the defense system, and upon the target reaching a predetermined distance from the defense system, the control means is caused to provide the control signal to release the cable.

5. A target that is connected by a cable to a tow aircraft and towed by the tow aircraft toward a defense system, said target comprising:

a target fuselage having flight surfaces that in combination with the mass of the target result in a downward force that causes the target to be towed at a substantially lower altitude in relation to the tow aircraft;

a cable release means within the target fuselage that upon receiving a control signal operates to disconnect the cable from the target;

a control means that provides a control signal to the cable release means at a predetermined time to cause release of the cable from the target, the control means further comprising a radio transmission receiver that enables a radio transmission from a location remote from the target to cause the control means to provide the control signal to release the cable; and a communication network between the defense system and the tow aircraft and between the tow aircraft and the target wherein the defense system transmits a continuous signal that is received and re-transmitted by the tow aircraft to the target body, wherein the control means is caused to provide the control signal to release the cable when the continuous signal ceases or is interrupted.

6. A target that is connected by a cable to a tow aircraft and towed by the tow aircraft toward a defense system, said target comprising:

a target fuselage having flight surfaces that in combination with the mass of the target result in a downward force that causes the target to be towed at a substantially lower altitude in relation to the tow aircraft;

a cable release means within the target fuselage that upon receiving a control signal operates to disconnect the cable from the target;

a control means that provides a control signal to the cable release means at a predetermined time to cause release of the cable from the target; and a deceleration means attached to the target fuselage which is activated upon release of the cable and retards the forward motion of the target, said deceleration means comprising a plurality of drag chutes that are ejected from the rear of the target fuselage upon release of the cable, said drag chutes comprising a cone of perforate material with a parachute canopy attached over the open end of the cone, and a cable securing the other end of the cone to the target fuselage.

7. A target that is connected by a cable to a tow aircraft and towed by the tow aircraft toward a ground or shipborne defense system comprising;

a target fuselage having controlled flight surfaces that in combination with the mass of the target result in a downward force that causes the target to be towed at a substantially lower altitude in relation to the tow aircraft;

cable release means that upon receiving a control signal operates to disconnect the cable from the target;

a control means that provides a control signal to the cable release means at a predetermined time to cause release of the cable from the target; and an altitude sensor within said target fuselage, said altitude sensor working in combination with said control means and said flight surfaces so as to maintain the target at a low altitude.

* * * * *